US005468437A

United States Patent [19]

Hall

[11] Patent Number: 5,468,437

[45] Date of Patent: Nov. 21, 1995

[54] PROCESS FOR PRODUCING STABILIZED NON-WOVEN THERMOPLASTIC COMPOSITES

[75] Inventor: Walter L. Hall, Mt. Vernon, Ind.

[73] Assignee: General Electric Company, Pittsfiled, Mass.

[21] Appl. No.: 182,883

[22] Filed: Jan. 18, 1994

[51] Int. Cl.[6] ..... B29C 59/02

[52] U.S. Cl. ..... 264/119; 264/112; 264/122; 264/134

[58] Field of Search ..... 264/109, 112, 264/113, 119, 122, 134; 428/143, 324, 454

[56] References Cited

U.S. PATENT DOCUMENTS

| | | | |
|---|---|---|---|
| 3,716,449 | 2/1973 | Gatward et al. | 162/101 |
| 4,056,501 | 11/1977 | Gibbs et al. | 260/29.6 |
| 4,323,531 | 4/1981 | Bradley et al. | 264/113 |
| 4,393,106 | 10/1981 | Maruhashi et al. | 428/35 |
| 4,426,470 | 9/1982 | Wessling et al. | 524/35 |
| 5,190,204 | 1/1991 | Katoh et al. | 264/22 |

FOREIGN PATENT DOCUMENTS

| | | |
|---|---|---|
| 0148760 | 7/1985 | European Pat. Off. . |
| 0148761 | 7/1985 | European Pat. Off. . |
| 0391076 | 10/1990 | European Pat. Off. . |
| WO/A8704476 | 7/1987 | WIPO . |

*Primary Examiner*—Robert A. Dawson
*Assistant Examiner*—Kenneth M. Jones

[57] ABSTRACT

A process is provided for producing a fiber reinforced thermoplastic sheet. The process involves the steps of forming a dilute aqueous slurry of organic polymer particulates and reinforcing fibers, collecting the particulates and fibers in the form of a continuous mat by dewatering the slurry over a porous substrate, applying a stabilizer composition to a surface of the solid mat, stamping of the mat at an elevated pressure and temperature to consolidate the organic polymer particulates and yield a solid sheet-like structure. The process provides for efficient application of the stabilizer composition by applying it to the mat separately from the formation of the slurry, and in the case of ultraviolet light stabilizers and absorbers, the process applies the stabilizers to the surface of the mat where they are most needed.

10 Claims, No Drawings

PROCESS FOR PRODUCING STABILIZED NON-WOVEN THERMOPLASTIC COMPOSITES

BACKGROUND OF THE INVENTION

1. Field Of the Invention

The present invention relates to processes for making fiber reinforced thermoplastic composites, and more particularly relates to processes for making stabilized fiber reinforced thermoplastic composites.

2. Description of the Related Art

Aqueous methods of making fiber reinforced composite materials from an aqueous slurry of, solid polymer and reinforcing material are known. See Published European Patent Applications 0,148,760 and 0,148,761, Wessling et al., U.S. Pat. No. 4,426,470 issued Jan. 17, 1984 and Gatward et al., U.S. Pat. No. 3,716,449 issued Feb. 13, 1973, all of which are incorporated herein by reference. In general these reinforced polymer composites have a uniform mixture of fiber, polymer and optionally binder and are prepared by performing dilute aqueous slurries of a solid heat-fusible organic polymer, a reinforcing material and optionally a latex binder. Wessling et al. U.S. Pat. No. 4,426,470 issued Jan. 17, 1984 discloses on column 4, lines 18–21 that various chemical additives such as antioxidants, UV stabilizers, thickeners, foaming agents, antifoaming agents, bactericides, electromagnetic radiation absorption agents, etc., may also be used in the composites comprising a heat-fusible polymer and reinforcing material.

While it has been recognized, that certain additives can be employed in fiber reinforced composites, there is a continuing need to improve the efficiency of the addition of such materials.

SUMMARY OF THE INVENTION

This invention provides a process for making stabilized reinforced thermoplastic composites which comprise steps of (a) forming a dilute aqueous slurry of (i) particulates of a solid, water insoluble, heat-fusible organic polymer and (ii) reinforcing fibers preferably having lengths of 0.1 to 2.0 inches, (b) collecting the particulates and fibers in the form of a continuous sheet or mat, dewatering, applying a stabilizer composition to a surface of the mat and stamping the mat at an elevated temperature and pressure to consolidate the organic polymer particulates.

DETAILED DESCRIPTION OF THE INVENTION

The process of this invention involves (1) an aqueous medium, preferably (2) a binder, usually at least partially in the form of a latex which contains either anionic or cationic bound charges, (3) a heat-fusible organic polymer which is in particulate form, (4) reinforcing fibers having fiber lengths of between 0.1 inches and 2.0 inches, and (5) optionally a flocculent.

In the process, a dilute aqueous slurry is prepared containing the heat fusible organic polymer particulates and the reinforcing fibers. The slurry is agitated and then uniformly distributed onto a porous support and is allowed to drain to form a wet mat, and a stabilizer composition is then applied to a surface of the mat. The wet mat is optionally passed through press rolls and then dried, such as passing the wet mat through a series of heated dryer rolls to obtain a stabilized dried mat which optionally is rolled onto a cylinder or collected as a flat sheet stock. The dried mat may then be subjected to various kinds of treatment for the intended use such as compression molding the dried mat into articles. Optionally, a binder material is employed in the dilute aqueous slurry and the solids are flocculated during agitation with a polymeric flocculent having an opposite charge to that of the latex binder. Suitable binders and flocculents are set forth in Wessling et al., U.S. Pat. No. 4,426,470 issued Jan. 17, 1984 which is incorporated herein by reference. Suitable latexes which can be used in the present invention include those described in U.S. Pat. No. 4,056,501, issued Nov. 1, 1977, to Gibbs et al., incorporated herein by reference.

The invention requires a normally solid, heat fusible organic polymer. By "heat fusible" is meant that the polymer particles are capable of deformation under heat to join into an unitary structure. The heat fusible polymers may be either thermoplastic or thermoset resins. The heat fusible organic polymer component of the present invention is desirably a hydrophobic, water insoluble addition polymer. These polymers are in particulate form and may be in the form of a powder or a dispersion. Suitable heat fusible organic polymers include addition and condensation polymers such as, for example, polyethylene; ultra high molecular weight polyethylene; chlorinated polyethylene; bipolymers of ethylene and acrylic acid; polypropylene; polyamides; phenylene oxide resins; phenylene sulfide resins; polyoxymethylenes; polyesters; terpolymers of acrylonitrile, butadiene and styrene; polyvinylchloride; bipolymers of a major proportion of vinylidene chloride and a minor proportion of at least one other alpha,beta-ethylenically unsaturated monomer copolymerizable therewith; and styrene homopolymers or copolymers. The polymer particulates generally and advantageously have a particle size in the range of 1 to 400 microns. The polymers are generally employed in an amount of from about 20 to 80 percent by weight of the solids, dry weight basis of the combined weight of fibers and particulates. A particularly preferred organic polymer is a polyolefin powder when such polymer has been prepared by the process of U.S. Pat. No. 4,323,531. Of course, blends of polymers may be used.

The reinforcement fibers include materials organic and inorganic materials such as graphite, metal fibers, aromatic polyamides, cellulose and polyolefin fibers, but preferably and advantageously comprises glass fibers such as chopped glass strands having a length of ⅛ to 1 inch (about 3.2 to 25.4 mm), milled glass fibers which generally have a length of about 1/32 to ⅛ inch (about 0.79 to 3.2 mm) and mixtures thereof. The glass fibers are advantageously heat cleaned and, to improve impact properties, such fibers may be compatibilized by having a thin coating of, for example a polyolefin resin or starch thereon. The fibers are preferably surface treated with chemical sizing or coupling agents which are well known in the art. The reinforcing material generally comprises from about 10 to about 80 weight percent of the composite.

The reinforcing fiber used in the process and composites of the present invention preferably have a distribution wherein at least 95% of said fibers have lengths of less than 2 inches, more preferably less than 1.5 inches, and even more preferably less than 1.1 inch.

The process for making the final composite formed article involves first forming a web or mat as defined above, followed by heating the mat to a temperature sufficient to melt the thermoplastic material and stamping the consolidated sheet into a final article.

The composites are formed by blending the heat-fusible polymer particulates, the reinforcing material, and the water, agitating to form a slurry, dewatering to form a continuous mat, drying, applying a stabilizer composition to a surface of the mat, the stabilizer composition comprising a stabilizer component selected from the group consisting of ultraviolet light stabilizers, primary antioxidants, secondary antioxidants and ultraviolet light absorbers, and compression molding of the mat by applying heat and pressure to the mat to melt the thermoplastic resin and form the stabilized sheet-like composite structure which can then be stamped to form the final article.

This method is conveniently and preferably carried out by first stirring the reinforcing material in water until it is uniformly disbursed, then slowly adding the heat-fusible polymer, and stirring the materials throughout this portion of the process. This slurry of water, heat-fusible polymer, reinforcing material and optionally latex binder and flocculent preferably has a total solids content of 0.01 to 5% solids by weight, and more preferably 0.02 to 0.5% solids by weight based on the total weight of the slurry.

The sheet-forming and dewatering process may be accomplished by any conventional paper making apparatus such as a sheet mold or a Fourdrinier or cylinder machines. Water based stabilizers are preferably applied after the dewatering step and before the drying step. Non-aqueous based stabilizer systems are preferably applied after the drying step.

After the mat is formed into a dewatered sheet, it may be desirable to densify the sheet by pressing it with a flat press or by sending it through calendering rolls. Densification after drying of the mat is particularly useful for increasing the tensile and tear strength of the mat. Drying of the mat may be either air drying at ambient temperatures or oven drying.

Suitable stabilizer compounds include hindered amines, hindered phenolics and organic phosphorous compounds, and are set out in Moore, Jr. U.S. Pat. No. 4,888,369 which is incorporated herein by reference. A hindered phenolic component selected from the group consisting of 1,3,5-tris(3,5-di-t-butyl-4-hydroxy-benzyl)-s-triazine, tetrakis [methylene (3-3', 5'-di-t-butyl-4'-hydroxyphenyl)propionate] methane, 1,3,5-tris-(4-t-butyl-3-hydroxy-2,6-dimethylbenzyl)-1,3,5-triazine-2,4,6 (1H, 3H, 5H)trione, and 3,5-di-t-butyl-4-hydroxycinnamic acid triester with 1,3,5-tris-(2-hydroxethyl)-s-double bond-triazine-2,4,6 (1H, 3H, 5H)trione, and a phosphorus containing component selected from the group consisting of tetrakis(2,4-di-t-butylphenyl)4,-4'-biphenylylene disphosphonite, tris(2,4-di-t-butylphenyl)-phosphite, trisnonylphenyl phosphite, bis(2,4-di-t-butylphenyl)pentaerythritol diphosphite, bis(distearyl)pentaerythritol diphosphite and bis(distearyl-)pentaerythritol diphosphite with one percent (1%) triethanolamine. Suitable hindered amine components include benzotriazoles, benzophenones and hindered piperidinyl compounds.

The stabilizer composition may be in the form of either a composition consisting of the stabilizer compound or may be in the form of a solution, emulsion or suspension. The stabilizer composition may be sprayed onto the mat. Preferably the stabilizer composition has the stabilizer compounds present at a high level, preferably the stabilizer compound is present at a level of at least 50% by weight based on the total weight of the stabilizer composition, more preferably a level of at least 80% by weight thereof, and most preferably at a level of at least 90% by weight thereof. By applying the stabilizer in its concentrated form as a separate step following formation of the mat, the stabilizer is efficiently incorporated into the mat rather than being carried out with the water of the slurry during the dewatering process, and in the case of ultraviolet stabilizers and absorbers, applying the stabilizer composition to the surface of the mat results in the ultraviolet light stabilizers and/or absorbers being present on the portion of the mat where they are most needed (i.e. the surface). Preferably the stabilizer composition consists of stabilizer compounds, and is applied to the mat after the drying step so as to reduce volatilization of the stabilizer composition. In the case of where the stabilizers are added in the forms of emulsions or suspensions, the drying step will need to follow the step of applying the stabilizer composition to the surface of the mat so that residual moisture will be removed from the mat prior to stamping thereof.

What is claimed is:

1. A process for producing a fiber reinforced thermoplastic sheet, said process comprising the steps of:

a) forming a dilute aqueous slurry of
   (i) particulates of a solid, water insoluble, heat-fusible organic polymer and
   (ii) reinforcing fibers having lengths of from 0.1 to 2.0 inches, b) collecting the particulates and fibers in the form of a continuous mat by dewatering the slurry over a porous support, c) applying a stabilizer composition to a surface of said mat, said stabilizer composition comprising a stabilizer compound selected from the group consisting of ultraviolet light stabilizers, primary antioxidants, secondary antioxidants and ultraviolet light absorbers.

2. The process of claim 1 wherein said process further comprises the step of drying the mat between said collecting step and said applying step.

3. The process of claim 1 wherein said process further comprises the step of drying the mat after said applying step.

4. The process of claim 1 wherein said process further comprises the step of stamping said mat at an elevated pressure and elevated temperature to consolidate the organic polymer particulates.

5. The process of claim 4 wherein said process comprises a drying step before said stamping step.

6. The process of claim 5 wherein said process consists essentially of said forming step, said collecting step, said applying step, said drying step and said stamping step.

7. The process of claim 5 wherein said organic polymer is polypropylene and said fiber is glass fiber.

8. A process for producing a fiber reinforced thermoplastic sheet, said process comprising the steps of:

a) forming a dilute aqueous slurry of:
   (i) particulates of a solid, water insoluble, heat-fusible organic polymer and
   (ii) reinforcing glass fibers having lengths of from 0.1 to 2.0 inches, said organic polymers being selected from the group consisting of polyolefins, polycarbonates, polyamides, polyesters, rubber modified graft copolymers, polyvinyl chlorides, polyvinyl aromatics, polyphenylene ethers, and mixtures thereof, b) collecting the particulates and fibers in the form of a continuous mat by dewatering the slurry over a porous support, c) applying a stabilizer composition to a surface of said mat, said stabilizer composition comprising a stabilizer component selected from the group consisting of hindered amines, hindered phenolics and organic phosphorous materials, d) stamping said mat at an elevated pressure and elevated temperature to consolidate the organic polymer particulates.

9. The process of claim 8 wherein said process comprises the step of drying the mat before said stamping step.

10. The process of claim 9 wherein said process consists essentially of said forming step, said collecting step, said applying step, said drying step and said stamping step.

* * * * *